United States Patent [19]

Lee

[11] Patent Number: 4,826,224

[45] Date of Patent: May 2, 1989

[54] DOOR LATCH ASSEMBLY

[75] Inventor: Sang L. Lee, Busan, Rep. of Korea

[73] Assignee: Goldstar Co., Ltd., Seoul, Rep. of Korea

[21] Appl. No.: 90,331

[22] Filed: Aug. 28, 1987

[51] Int. Cl.[4] ..... E05C 3/34

[52] U.S. Cl. ..... 292/254; 292/25; 292/DIG. 69

[58] Field of Search ..... 292/254, 336.3, 25, 292/30, 122, 127, 199, DIG. 69

[56] References Cited

U.S. PATENT DOCUMENTS 1,089,324 3/1914 Chesley ..... 292/254 X
1,213,651 1/1917 Johns ..... 292/199 X
2,618,140 11/1952 Zellweger ..... 292/127 X
4,341,409 7/1982 Sakoda ..... 292/254

*Primary Examiner*—Richard E. Moore
*Attorney, Agent, or Firm*—Rosen, Dainow & Jacobs

[57] ABSTRACT

A latch assembly for securing a microwave oven door comprising two latch pawls engaging latch hangers, a vertically reciprocable or movable member having an elongated hole, a rack and two spaced legs, a spring-biased pinion contacting with a push-button. The force applied by the spring bias facilitates closing and opening the door. Upon pushing a button which rotates the pinion counter-clockwise, thereby reciprocating the movable member having the rack upwardly to disengage the latch pawls from the latch hangers.

10 Claims, 1 Drawing Sheet

FIG,1
(PRIOR ART)
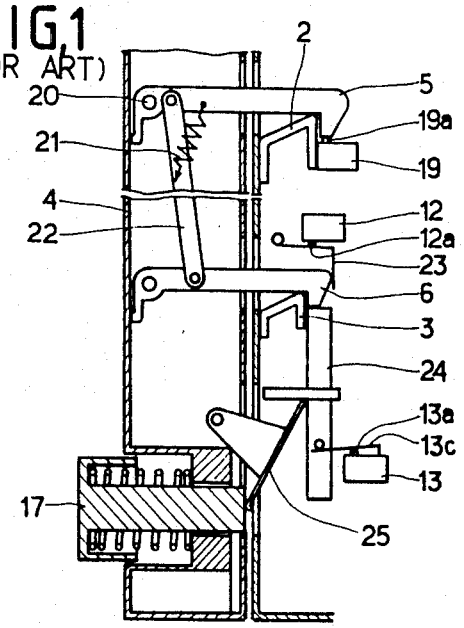
FIG,2A
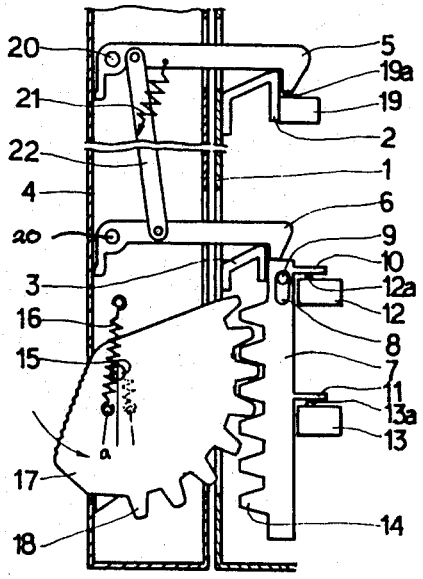
FIG,2B
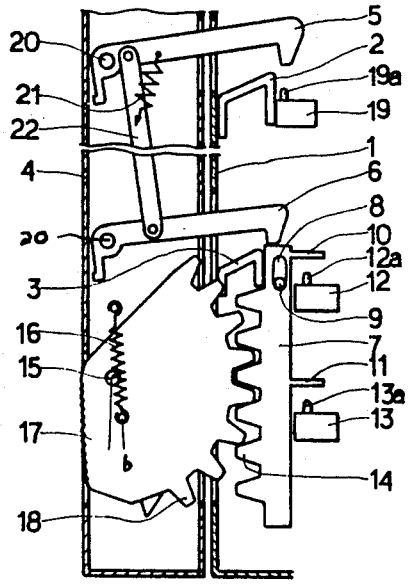

DOOR LATCH ASSEMBLY

FIELD OF THE INVENTION

This invention relates to a latch assembly and particularly to improvements in a latch assembly used in a microwave oven.

BACKGROUND OF THE INVENTION

A known latch assembly used in a microwave oven has customarily comprised a plurality of component parts for assuring that there is very little leakage of microwave energy during operation of the oven. This latch assembly is expensive because of such component parts, or inadequate due to a malfunction of movable parts. In addition, considerable manual force is required to push a push-button to open the door of the oven.

SUMMARY OF THE INVENTION

An object of this invention is to provide a latch assembly that operates easily and effectively with a minimum of manipulation and manual force.

A further object of this invention is to provide a latch assembly for assuring that a door is properly closed so that there is no leakage of microwave energy during operation of the oven.

A still further object of the present invention is to provide a latch assembly for a microwave oven which is of low cost and which may be easily manufactured by virtue of its simple construction.

Another object of this invention is to provide a latch assembly in which the switches permitting energization of the microwave generator in a microwave oven operate properly and exactly.

In accordance with the objects of this invention the latch assembly comprises spaced latch pawls secured to the inside of the oven door, first and second latch hangers to which the latch pawls respectively engaged; a movable member having a rack, two legs for actuating a monitor switch and a secondary switch and an elongated guide hole for receiving a projection formed on the inside of an outer casing; and a pinion connected with a push-button on the outside of the door engaging the rack.

BRIEF DESCRIPTION OF THE DRAWINGS

The specific nature of the invention, as well as other objects and advantages thereof, will clearly appear from the description and from the accompanying drawings, in which:

FIG. 1 is a side view of a known latch assembly, partially broken away;

FIG. 2-A is a side, partially broken away view of a latch assembly in the latched position constructed in accordance with the present invention;

FIG. 2-B is similar to FIG. 2-A but showing the latch assembly in the unlatched position thereof.

DETAILED DESCRIPTION OF THE INVENTION

Referring to FIG. 1 which shows a known latch assembly, the latch assembly may comprise first and second spaced pawls 5, 6 pivotally secured to the inside of a door 4 by shafts 20, a connecting bar 22 connecting the first and second latch pawls, a coil spring 21 having one end secured to the latch pawl 5 and the other end to the inside of the door 4, first and second spaced latch hangers 2, 3 each having one end secured to the front face 1 of the oven, a vertically movable bar 24 placed under the latch pawl 6, a connecting lever 25 connecting a push-button 17 to the movable bar 24.

In the prior art embodiment illustrated, upon pushing push-button 17 to open door 4, the connecting lever 25 moves the movable bar 24 upwardly causing the latch pawl 6 to disengage the latch hanger 3 and, via connecting bar 22, the latch pawl 5 to disengage the latch hanger 2 whereby the door 4 is opened.

Upon closing the door, the latch pawl 5 engages the latch hanger 2 causing a downwardly depending hook projection thereof to depress a button 19*a* that actuates a switch 19, while the latch pawl 6 engages the latch hanger 3 causing a downwardly depending hook projection thereof to push the movable bar 24 downwardly depressing an actuator arm 13*c* to cause a secondary switch 13 to be actuated, and at the same time the latch pawl 6 pushes an actuator arm 23 to actuate a monitor switch 12 as shown in FIG. 1.

The above known latch assembly has the disadvantages referred to above which are overcome by a variation of the latch assembly constructed in accordance with the present invention.

Referring now to FIG. 2-A, first and second latch pawls 5,6, first and second latch hangers 2,3, and the connecting bar 22 perform generally the same functions as before. However, there are provided a movable or reciprocable member 7 in the form of a rack 14 having an elongated guide slot or hole 8 formed thereon for receiving a support projection 9 secured inside the oven and two spaced legs 10,11, and a pinion 18 secured to a rocker or pivotable push button 17. Slot 8 and projection 9 limit reciprocation of member 7. Spring 16 is connected to push button 17 and the inside of door 4.

With this arrangement upon closing the door 4, the latch pawls 5,6 engage the hangers 2,3 respectively and they are maintained in engagement with hangers 2,3 by the force of the spring 21. In that condition, the downwardly depending hook projection of the latch pawl 5 depresses the button 19*a* that actuates the switch 19 while the downwardly depending hook projection of the latch pawl 6 moves or reciprocates the movable member 7 downwardly until support projection 9 enages the upper end of slot 8 causing the legs 10,11 to depress the buttons 12*a*, 13*a* that actuate the switches 12,13, respectively.

The forces of those springs 16,21 as well as the manual force applied to push button 17 aid in the proper functioning of the switches 12,13 and 19. In more detail, upon closing the door 4 the force applied by the spring 16 forces the pinion 18 to rotate in a counterclockwise direction from the position depicted in FIG. 2B (see reference "b") to the position depicted in FIG. 2A, (see reference "a"), which causes the movable member 7 move downwardly. Upon pushing i.e., pivoting the button 17 to open the door 4, the pinion 18 rotates in the clockwise direction from the latched position thereof depicted in FIG. 2A (see reference "a") to the unlatched position thereof depicted in FIG. 2B (see reference "b") forcing the movable member 7 to move upwardly along one end 3*a* of hanger 3 until thereby the support projection 9 engages the lower end of slot 8 and the latch pawl 6 is disengaged from hanger 3, as shown in FIG. 2-B When the door 4 is closed, the latches 5,6 moves downwardly along the slanting surface of the hangers 2,3, respectively, to engage the hangers 2,3, as shown in FIG. 2-A.

Although the invention has been described in its preferred form with a certain degree of particularity, it is understood that the present disclosure of the preferred form has been changed in the details of construction and the comblnation and arrangement of parts may be resorted to without departing from the spirit and the scope of the invention as hereinafter claimed.

What is claimed is:

1. A latch assembly for latching a door of a microwave oven to said oven, said latch assembly comprising:

a first latch pawl pivotally fastened to an interior side of said door facing the inside of said oven;

a first latch hanger secured to a front face of said oven;

said first latch pawl and said first latch hanger being positioned and such that in a closed condition of said door said first latch pawl engages said first latch hanger;

a pinion pivotally secured to said door;

a push button associated with said pinion accessible from an exterior side of said door opposite said interior side, such that actuation of said push button pivots said pinion;

a rack secured to said door for reciprocating movement therealong between latched and unlatched positions corresponding to latching and unlatching of said latch assembly, said rack being positioned to couple movement thereof to said first latch pawl and to be engaged by said pinion and reciprocated upon pivoting of said pinion, reciprocating movement of said rack causing unlatching of said first latch pawl;

means for limiting reciprocation of said rack between said latched and unlatched positions;

at least one switch secured to said oven;

said rack having means contacting said at least one switch in one of said positions of said rack for activating said switch in said at least one position of said rack.

2. The latch assembly according to claim 1 wherein said push button and said pinion are attached to each other and pivotably mounted as a unit such that pivoting of said push button pivots said pinion, and including means resiliently urging said pinion, after said push button has been pivoted, in a direction urging said rack into its unlatched position and after said door is closed in a direction urging said rack into its latched position.

3. A latch assembly for latching a door of a microwave oven to said oven, said latch assembly comprising:

first and second latch pawls pivotally fastened to an interior side of said door facing the inside of said oven;

first and second latch hangers secured to a front face of said oven;

said first and second latch pawls and said first and second latch hangers being positioned such that in a closed condition of said door said first latch pawl engages said first latch hanger and said second latch pawl engages said second latch hanger;

means coupling movement of said first latch pawl to said second latch pawl;

a pinion pivotally secured to said door;

a push button associated with said pinion accessible from an exterior side of said door opposite said interior side, such that actuation of said push button pivots said pinion;

a rack secured to said door for reciprocating movement therealong between latched and unlatched positions corresponding to latching and unlatching of said latch assembly, said rack being positioned to couple movement thereof to said first latch pawl and to be engaged by said pinion and reciprocated upon pivoting of said pinion, reciprocating movement of said rack causing unlatching of said first latch pawl;

means for limiting reciprocation of said rack between said latched and unlatched positions;

at least one switch secured to said oven;

said rack having means contacting said at least one switch in one of said positions of said rack for activating said switch in said at least one position of said rack.

4. The latch assembly according to claim 3 wherein said push button and said pinion are attached to each other and pivotably mounted as a unit such that pivoting of said push button pivots said pinion, and including means resiliently urging said pinion, after said push button has been pivoted, in a direction urging said rack into its unlatched position and after said door is closed in a direction urging said rack into its latched position.

5. The latch assembly according to claim 4 wherein said urging means comprises a spring coupled to said pinion and said door.

6. The latch assembly according to claim 3 wherein said means coupling movement of said first and second latch pawls comprises a bar pivotally interconnecting said latch pawls.

7. The latch assembly according to claim 3 wherein said rack means contacting said at least one switch comprises, for each said switch, a leg projecting from said rack.

8. The latch assembly according to claim 3 wherein said latch assembly includes two switches and said rack means contacting said it least one switch comprises two legs projecting from said rack, one leg for contacting each said switch, said legs and said switches being positioned such that a respective leg contacts and activates a respective switch in the closed condition of said door.

9. The latch assembly according to claim 3 wherein said means limiting reciprocation of said rack comprises an elongated slot and means engaging opposed ends of said slot in said latched and unlatched positions of said rack.

10. The latch assembly according to claim 3 wherein said latch hangers are U-shaped.

* * * * *